US007283051B2

(12) United States Patent
Sakamoto et al.

(10) Patent No.: US 7,283,051 B2
(45) Date of Patent: Oct. 16, 2007

(54) MANAGEMENT SYSTEM AND MANAGEMENT METHOD FOR MANAGING A WIRELESS TAGGED ARTICLE

(75) Inventors: Kenji Sakamoto, Yokosuka (JP); Naoharu Yamada, Yokohama (JP); Goro Kunito, Yokosuka (JP); Kenichi Yamazaki, Hino (JP)

(73) Assignee: NTT DoCoMo, Inc., Tokyo (JP)

( * ) Notice: Subject to any disclaimer, the term of this patent is extended or adjusted under 35 U.S.C. 154(b) by 127 days.

(21) Appl. No.: 11/110,726

(22) Filed: Apr. 21, 2005

(65) Prior Publication Data

US 2005/0242922 A1 Nov. 3, 2005

(30) Foreign Application Priority Data

Apr. 22, 2004 (JP) ..... 2004-126986

(51) Int. Cl.
*G08B 13/14* (2006.01)

(52) U.S. Cl. ..... 340/572.1; 340/572.4; 340/568.1; 340/5.8; 235/375

(58) Field of Classification Search .. 340/572.1–572.9, 340/5.1–5.91; 235/375
See application file for complete search history.

(56) References Cited

U.S. PATENT DOCUMENTS 5,886,634 A * 3/1999 Muhme ..... 340/572.1
5,920,261 A 7/1999 Hughes et al.
6,097,301 A * 8/2000 Tuttle ..... 340/693.9
6,232,877 B1 * 5/2001 Ashwin ..... 340/572.1
6,259,367 B1 * 7/2001 Klein ..... 340/572.1
6,335,685 B1 1/2002 Schrott et al.
6,476,718 B1 11/2002 Cartwright et al.
6,476,728 B1 * 11/2002 Sakakibara ..... 340/870.02
6,563,417 B1 * 5/2003 Shaw ..... 340/10.1
6,825,766 B2 * 11/2004 Hewitt et al. ..... 340/572.7
6,836,843 B2 * 12/2004 Seroussi et al. ..... 713/173
6,967,577 B2 * 11/2005 Taylor et al. ..... 340/572.1
2003/0117268 A1 6/2003 Hewitt et al.
2003/0156026 A1 * 8/2003 Eagleson et al. ..... 340/505
2003/0217892 A1 * 11/2003 Persky ..... 186/68

FOREIGN PATENT DOCUMENTS

JP 2003-263611 9/2003
JP 2004-32587 1/2004
WO WO99/38136 7/1999
WO WO 03/060773 A1 7/2003

* cited by examiner

*Primary Examiner*—Jeffery Hofsass
*Assistant Examiner*—Hoi C. Lau
(74) *Attorney, Agent, or Firm*—Oblon, Spivak, McClelland, Maier & Neustadt, P.C.

(57) ABSTRACT

A management system includes a manager determining unit determining a manager who manages an article, a user determining unit determining a user related to the article based upon detection of a wireless tag by a wireless tag reader, and an attribute information holding unit holding a wireless tag identifier, the manager, and the user while associating them with each other. The wireless tag identifier uniquely identifies a wireless tag.

6 Claims, 7 Drawing Sheets

FIG.3

PLEASE REGISTER MANAGER OF
ARTICLE WITH TAG 101

ID : 101

MANAGER: TANAKA

DATE OF ATTACHMENT: JANUARY 1 2004

SEND CLEAR

FIG.4

50

| 50a WIRELESS TAG IDENTIFIER | 50b MANAGER | 50c USER | 50d USER LEVEL |
|---|---|---|---|
| 101 | TANAKA | - | - |
| 102 | SATO | - | - |
| 103 | ITO RENTAL SHOP | - | - |
| 104 | KATO | - | - |

MANAGEMENT SYSTEM AND MANAGEMENT METHOD FOR MANAGING A WIRELESS TAGGED ARTICLE

CROSS REFERENCE TO RELATED APPLICATIONS

This application is based upon and claims the benefit of priority from prior Japanese Patent Application P2004-126986 filed on Apr. 22, 2004; the entire contents of which are incorporated by reference herein.

BACKGROUND OF THE INVENTION

1. Field of the Invention

The present invention relates to system and method for managing a wireless tagged article.

2. Description of the Related Art

There is a conventional method suggested for providing services and information based upon attribute information (for example, owner information) associated with a wireless tag identifier (wireless tag ID) of an article to which a wireless tag is attached.

For example, a following method is disclosed. Where a wireless tag is attached to a train passenger and the passenger gets into a bullet train, a wireless tag reader installed in a door of the bullet train detects the wireless tag of the passenger. Since the name and possessions of such wireless tag holder are already registered in a database, a train conductor refers to the database to find a doctor or a person possessing medicine. (See Japanese Patent Laid-Open Publication No. 2004-32587. for example.) There is also disclosed a system for identifying an owner of an article through a wireless tag attached to the article where the article has been illegally abandoned so that the owner is held accountable for the abandonment. Alternatively, where the article has been lost, this system is used to return the article to its owner. (See Japanese Patent Laid-Open Publication No. 2003-263611. for example.)

With the above-mentioned conventional technologies, for an owner of one article, only one person or one organization (for example, a company) could be set. Even if an article has a plurality of owners, these owners will be described in parallel, without referencing any hierarchy, thus only resulting in a plurality of contact persons or search results.

Hence, it is difficult to keep track of a status of an article accurately when, for example, the owner of the article has lent the article to the other person or the article is being transported by a transportation company commissioned by the owner. This is because a person other than the owner holds the article.

In the light of the above problems, an objective of the present invention is to provide a management system and a management method for holding information regarding multiple kinds of owners and grasping a status of an article accurately.

SUMMARY OF THE INVENTION

In order to achieve the abovementioned objective, the first characteristic of the present invention is a management system which manages an article to which a wireless tag is attached, comprising: a manager determining unit determining a manager who manages the article; a user determining unit determining a user related to the article based upon an detection of the wireless tag by a wireless tag reader; and an attribute information holding unit holding a wireless tag identifier, the manager, and the user while associating them with each other, the wireless tag identifier uniquely identifying the wireless tag. Here, the "manager" and the "user" may not only be natural persons but also corporate bodies or other kinds of organizations.

According to the management system of the first characteristic, information related to plural kinds of owners such as information of the manager and the user is held, enabling a status of the article to be grasped accurately. Therefore, an appropriate service can be provided in accordance with the status of the article.

In the management system of the first characteristic, the manager determining unit may determine a new manager where a predetermined wireless tag reader has detected a wireless tag or a predetermined sensor has detected a wireless tag, the new manager being determined based upon the detection, and the attribute information holding unit may hold information of the new manager. According to this management system, a new manager can be set when the article has been purchased or abandoned.

In the management system according to the first characteristic, the user determining unit may set a user level for each of the users based upon detection by a predetermined wireless tag reader or detection by a predetermined sensor, the user level indicating a degree of relation between each of the users and the article, and the attribute information holding unit may hold the users and the user levels while associating them with each other, respectively. According to this management system, degrees of relations between the users and articles are held. Therefore, a service can be provided in accordance with a degree of relation.

The second characteristic of the present invention is a method for managing an article to which a wireless tag is attached, comprising: determining a manager who manages the article; determining a user related to the article based upon detection of the wireless tag by a wireless tag reader; and holding a wireless tag identifier, the manager, and the user while associating with each other, the wireless tag identifier uniquely identifying the wireless tag.

According to the management method of the second characteristic, information related to plural kinds of owners such as information of the manager and the user is held. Therefore, a status of an article can be grasped accurately.

BRIEF DESCRIPTION OF THE DRAWINGS

FIG. 3 is a view showing an example of a screen for manager registration in the management system according to the embodiment.

FIG. 4 is a view showing an example of an attribute database in the management system according to the embodiment.

DETAILED DESCRIPTION OF THE INVENTION

Figure 1:
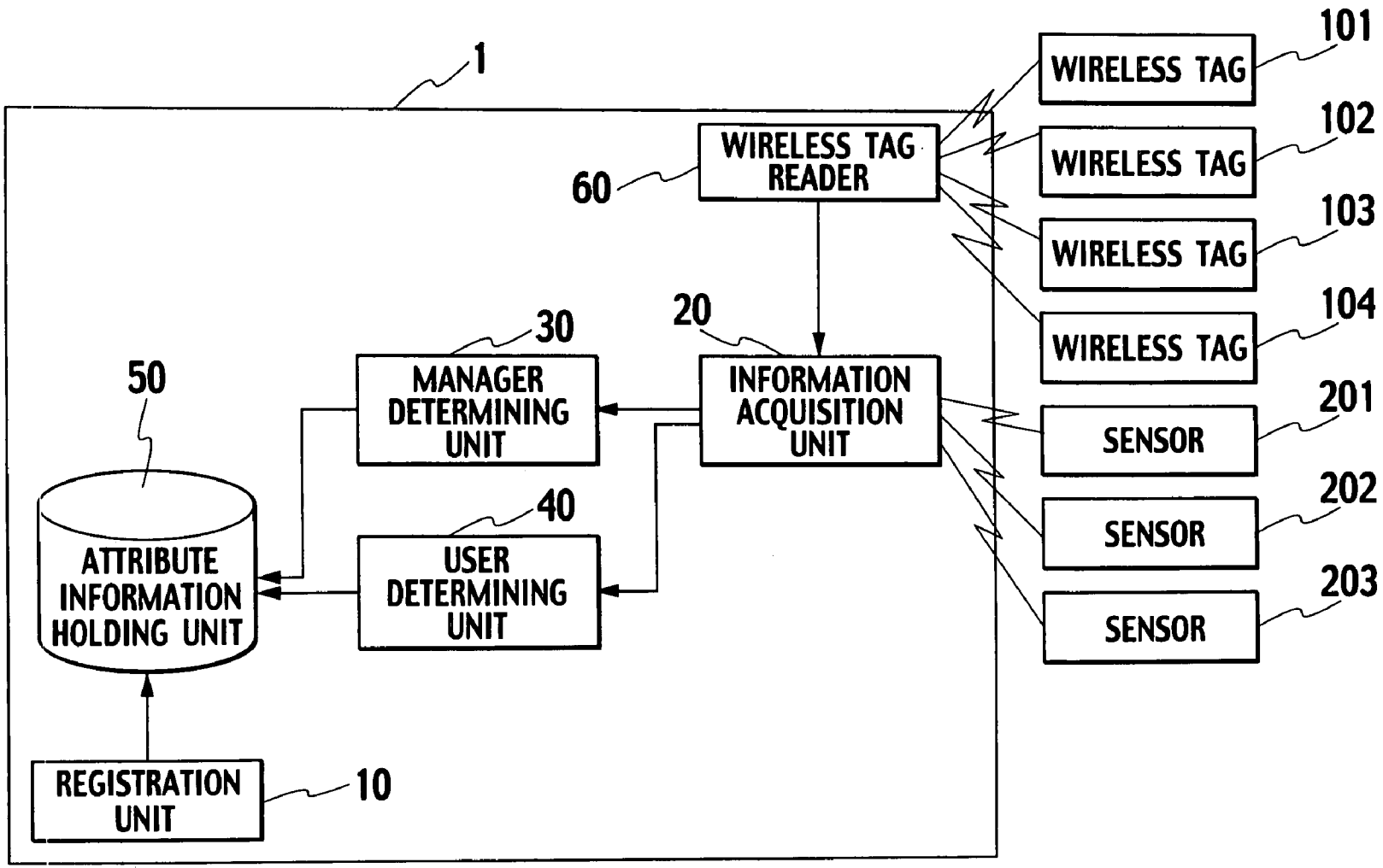
FIG. 1 is a block diagram of the structure of a management system according to an embodiment.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

(Management System)

In the management system according to the embodiment, two attributes, manager and user, are set in a database as information of owners of articles to which wireless tags are attached. The wireless tag is, for example, a RF-ID (radio frequency identification) tag and holds a wireless tag identifier (a wireless tag ID) which uniquely identifies the wireless tag. The wireless tag transmits a signal with a predetermined frequency corresponding to the ID at predetermined interval through a transmission antenna.

As shown in FIG. 1, the management system according to this embodiment comprises a registration unit 10, an information acquisition unit 20, a manager determining unit 30, a user determining unit 40, an attribute information holding unit 50, and a wireless tag reader 60.

Figure 2:
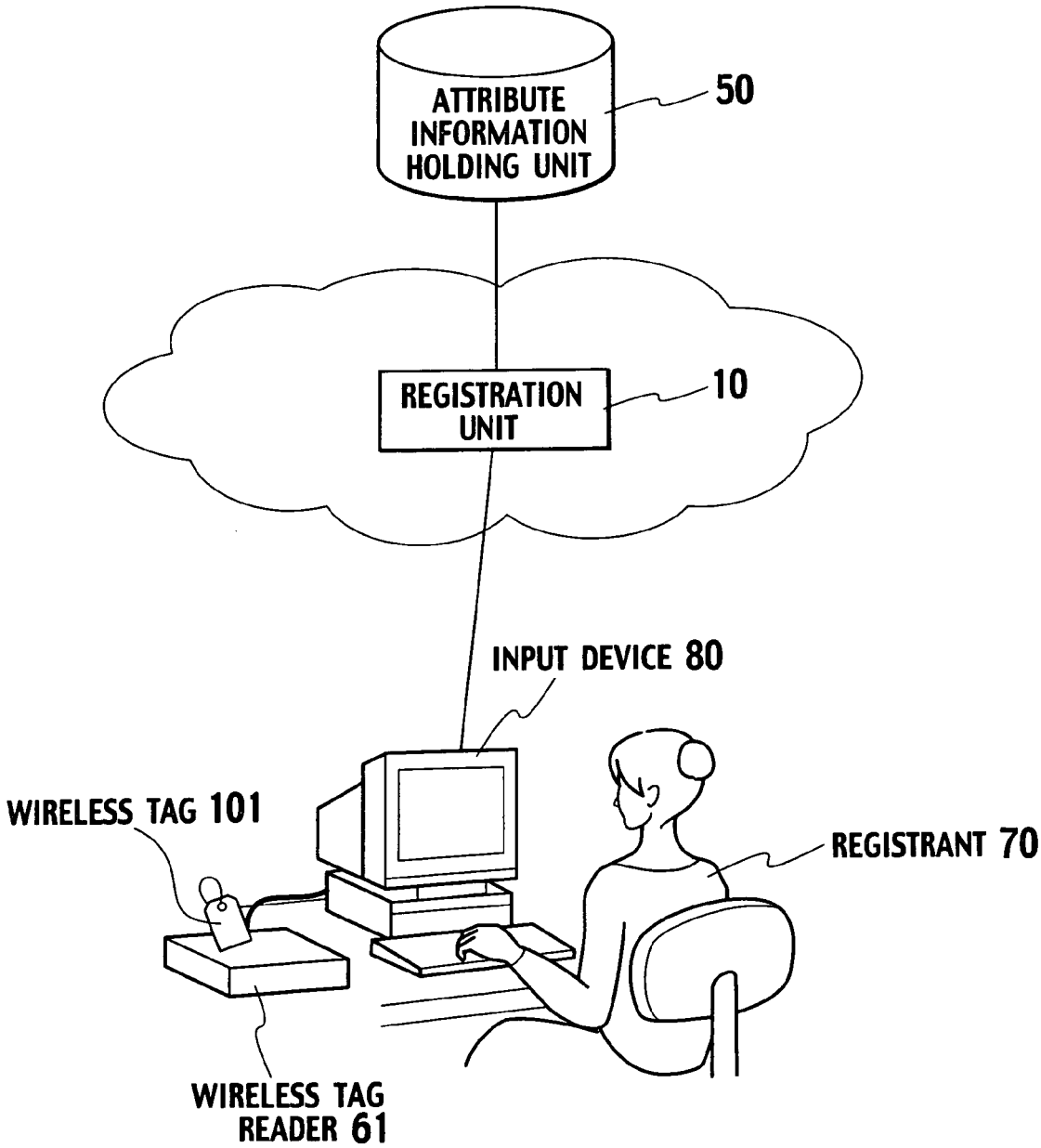
FIG. 2 is a schematic view explaining registration of a manager in the management system according to the embodiment.

When a wireless tag is attached to an article, the registration unit 10 registers manager information to an attribute database. The "manager" is a person who manages the article and more specifically a person (including a corporate body, an organization and the like) who holds the right to abandon the article. To be more specific, a registrant 70 can register him/herself using an input device 80 such as a personal computer as shown in FIG. 2. For example, the registration unit 10 is a web server, and once a wireless tag reader 61 detects a wireless tag 101, the input device 80 makes access to the registration unit 10 and a screen is displayed as shown in FIG. 3. After the registrant 70 inputs information into the "manager" section and presses "send", the manager information is registered in the attribute information holding unit 50 through the registration unit 10.

Alternatively, in order to register a manager in the attribute database, a person who has attached a wireless tag to the article and a wireless tag identifier engraved on the surface of the wireless tag may be identified by image analysis using a sensor such as a camera attached to environments or an article.

As shown in FIG. 4, the attribute information holding unit 50 holds wireless tag identifiers, manager information, user information, and user levels in an attribute database while associating them with each other. More specifically, the attribute database has a region 50*a* for storing wireless tag identifiers, a region 50*b* to which managers are registered, a region 50*c* to which users are registered, and a region 50*d* to which user levels are registered.

Upon receipt of information about an article from the wireless tag reader 60 and sensors 201, 202, and 203, the information acquisition unit 20 transmits the information to the manager determining unit 30 and the user determining unit 40. The information may be transmitted simultaneously with the acquisition of the information from the wireless tag reader 60 and the sensors 201, 202 and 203 or may be transmitted at predetermined intervals (for example, every minute). The sensors 201, 202 and 203 may be, for example, cameras, card readers, and other sensors detecting a status of an object (for example, tilt sensors or temperature sensors).

The manager determining unit 30 determines a manager who manages an article, specifically a manager holding a right to abandon the article. To be more specific, the manager determining unit 30 determines whether a manager of an article is to be changed based upon the information from the information acquisition unit 20. Where the manager needs to be changed, the manager determining unit 30 determines a new manager based upon the information from the information acquisition unit 20 and registers the new manager to the attribute information holding unit 50.

One of conditions for determining a change of a manager of an article is that the article has been sold or purchased. Specifically speaking, where a wireless tag reader 60 at a cash register in a supermarket detects a wireless tag identifier attached to an article to be purchased and a credit card is swiped through a card reader (the sensor 201, 202 or 203) to pay for the article, the information of the identifier and the credit card is transmitted to the information acquisition unit 20. Upon receipt of the information from the information acquisition unit 20, the manager determining unit 30 recognizes that the article is being purchased and determines that the manager of the article is to be changed.

In the above example, the supermarket is the initial manager information corresponding to the wireless tag attached to the article. In accordance with the wireless tag identifier attached to the purchased article as well as the information of the purchaser registered in the credit card, the manager determining unit 30 determines that the manager corresponding to the wireless tag has been changed to the purchaser of the article and registers the change to the attribute database.

Another example of the conditions for determining a change of a manager of an article is that the article has been abandoned. Specifically, where an article has been abandoned in one of a garbage collection sites throughout a city, a wireless tag reader 60 installed in the garbage collection site detects the wireless tag attached to the article and transmits the detected information to the information acquisition unit 20. By receiving the information from the information acquisition unit 20, the manager determining unit 30 can recognize that the article has been abandoned and determines to change the manager of the article.

In this example, the purchaser of the article is the initial manager information corresponding to the wireless tag attached to the article. In addition, a municipality which manages the garbage collection site is registered in the garbage collection site. The municipality is registered by attaching a wireless tag representing the municipality to the garbage collection site. When the wireless tag of the article and the wireless tag indicating the municipality and attached to the garbage collecting site are detected at the same time, the manager determining unit 30 may determine a change of the manager of the article. Alternatively, information of the municipality may be allocated in advance to the wireless tag reader 60 installed in the garbage collection site, and when the manager determining unit 30 is notified of the information of the municipality allocated to the wireless tag reader together with the wireless tag identifier detected by the wireless tag reader 60, the manager determining unit 30 may determine a change of the manager of the article.

Yet another example of the conditions for determining a change of a manager of an article is that the article has been transferred. Specifically, where an article has been transferred from a person to another, a wireless tag reader 60 mounted on a mobile phone or the like detects a new manager and transmits the information to the information acquisition unit 20. By receiving the information from the information acquisition unit 20, the manager determining unit 30 can recognize that the article has been transferred and determines a change of the manager of the article.

However, in the case of transfer of an article, there is a problem in that a difference between transfer and lending of an article is difficult to distinguish. In order to address this problem, a person to whom an article has been transferred may operate his/her own mobile phone with a wireless tag reader so that the mobile phone is set to a transfer mode. The person then allows the wireless tag reader mounted on the mobile phone to read the wireless tag of the article. Once the wireless tag identifier and the information related to the mobile phone (including the information of the "transfer mode") are transmitted to the information acquisition unit 20 from the mobile phone, the information acquisition unit 20 notifies the manager determining unit 30 of the information. The manager determining unit 30 thus recognizes that the article has been transferred and determines that the manager of the article is to be changed.

Meanwhile, the user determining unit 40 determines a user related to an article based upon a wireless tag detected by a wireless tag reader. Moreover, the user determining unit 40 determines whether a user of an article is to be changed based upon information from the information acquisition unit 20. Where the user is to be changed, the user determining unit 40 determines a new user and a user level based upon the information from the information acquisition unit 20 and registers them to the attribute information holding unit 50.

The "user" means a person (including a corporate body or an organization) with some relation to the article, and different degrees of such relation are represented by user levels. The user level 1 represents the lowest degree of the relation. A higher degree of the relation is expressed by a larger number, and the user level 6 represents the strongest relation. Each user level has a condition to be satisfied. Where a user satisfies the condition for a certain user level, the user is set at the user level.

Figure 5:
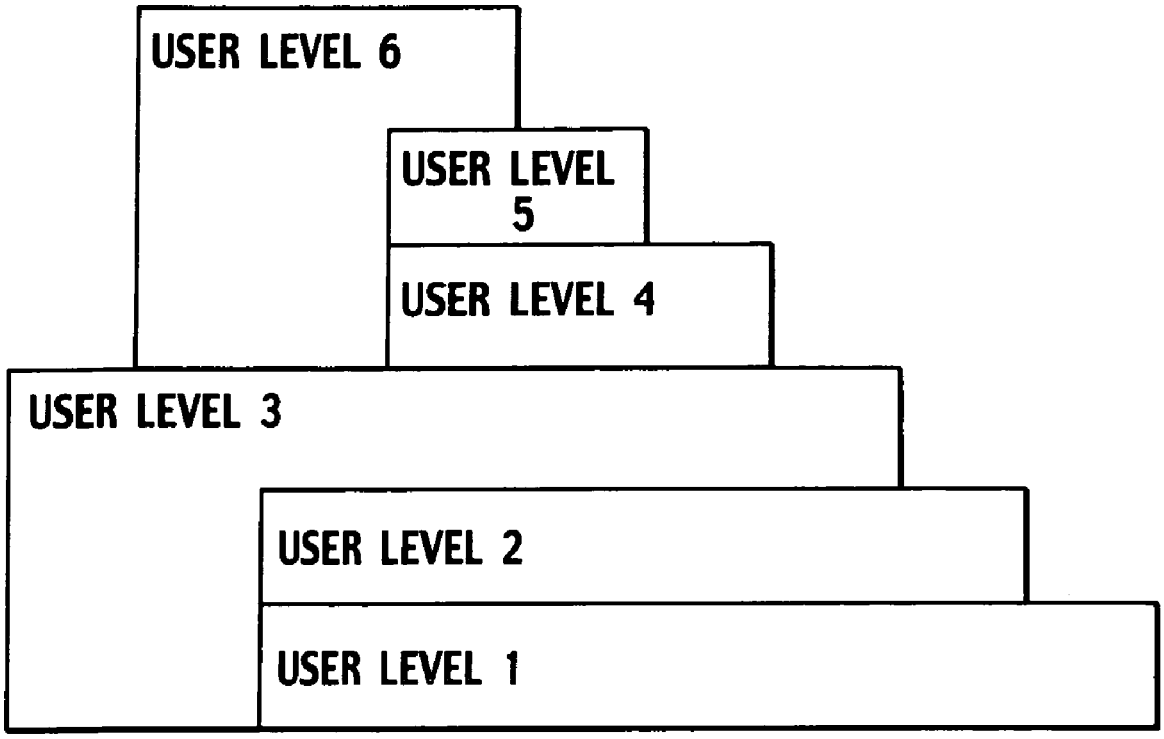
FIG. 5 is a schematic view explaining user levels in the management system according to the embodiment.

FIG. 5 shows relations among the user levels. A user at a higher user level satisfies a condition for a lower user level. For example, a user at the user level 2 must always satisfy the condition for the user level 1. Nevertheless, a user level at the user level 3 may satisfy the conditions for the user levels 1 and 2 or may not satisfy the conditions for the user levels 1 and 2 but satisfy only that of the user level 3. By dividing the users into levels in the above-described manner, a relation between each user and an article can be expressed.

Next, the conditions for the respective user levels are described.

The condition for the user level 1 is "proximity to an article". This means that, where a person is proximate to an article, the level of the user regarding the article is set at the user level 1. A specific example is a case where the wireless tag reader 60 detects a wireless tag attached to a person and a wireless tag attached to an article at the same time.

The condition for the user level 2 is "proximate duration". This means that, when a person is proximate to an article for a predetermined period of time or longer, the level of the user regarding the article is set at the user level 2. A specific example is a case where a wireless tag reader 60 detects a wireless tag attached to a person together with a wireless tag attached to an article for a predetermined period of time (for example 30 seconds) or longer.

The condition for the user level 3 is "awareness". This means that, where a person becomes aware of presence of an article and pays his/her attention to it, the level of the user regarding the article is set at the user level 3. A specific example is a case where a person's actions are traced through a wireless tag attached to the person, and the person walks straight towards an article or walks around the article. Another specific example is a case where a wireless tag attached to a sofa exclusively for watching a television and a wireless tag attached to the sofa and a wireless tag attached to a person are detected at the same time. This detection is understood that the person is sitting on the sofa paying attention to the television.

A user at the user level 3 may satisfy the conditions for the user levels 1 and 2 and may only satisfy the condition for the user level 3. In the first two of the above three examples, the conditions for the user levels 1 and 2 are satisfied because the person is proximate to the article. However, in the last example, the person is not necessarily proximate to the article.

The condition for the user level 4 is "taking up an article in a hand". This means that, where a person takes up an article in his/her hand, the level of the user regarding the article is set at the user level 4. A specific example is a case where a wireless tag reader 60 installed in a shelf can no longer detect an article which was on the shelf, and a wireless tag reader mounted on a mobile phone detects a tag attached to a person together with a wireless tag attached to the article.

The condition of the user level 5 is "holding an article". This means that, where a person is holding an article, the level of the user regarding the article is set at the user level 5. A specific example is a case where the wireless tag reader 60 mounted on a mobile phone detects a wireless tag attached to a person together with a wireless tag attached to an article for a predetermined period of time (for example, one minute) or longer.

The condition for the user level 6 is "use". This means that, where a person is using an article, the level of the user regarding the article is set at the user level 6. A specific example is a case where household appliances such as an air conditioner, a refrigerator and the like are checked whether they are ON or not by using sensors 201, 202 and 203 so that whether the household appliances are being used can is determined. In a case of a pencil, tilt sensors 201, 202 and 203 attached to the pencil can be used to determine whether the pencil is being used. As for a cup, temperature sensors 201, 202 and 203 can be used to detect whether the cup contains any liquid to determine whether the cup is being used. Meanwhile, when, for example, a person is wiping a floor using dry dust cloth, it is difficult to determine whether the dust cloth is being used even if sensors are used. In such a case, actions of the person are filmed by a camera or the like installed in the environment and whether the dust cloth is being used can be determined by analyzing the image taken by the camera or the like.

The management system 1 according to this embodiment may include a central processing unit (CPU) and have a construction where the information acquisition unit 20, the manager determining unit 30, and the user determining unit 40 are incorporated in the CPU as modules. These modules can be realized by executing an exclusive program for the use of a predetermined program language in a general-use computer such as a personal computer.

The attribute information holding unit 50 is a recording medium for storing attribute information regarding an article such as information of the manager or the user. The recording medium may be, for example, a RAM, a ROM, a hard disk, a flexible disk, a compact disc, an IC chip, or a cassette tape. With this recording medium, attribute information can be stored, conveyed, and sold easily.

Although not illustrated, the management system 1 may also be provided with a program holding unit which stores a management program for causing the CPU to execute a manager determining process, a user determining process and the like. The program holding unit may be a recording medium such as a RAM, a ROM, a hard disk, a flexible disk, a compact disc, an IC chip, or a cassette tape. With this recording medium, attribute information can be stored, conveyed, and sold easily.

(Management Method)

Next, the management method according to this embodiment is described with reference to FIGS. 6 to 9.

(a) First of all, a wireless tag is attached to an article in step S101. Then, in step S102, the registration unit 10 registers a manager of the article to the attribute information holding unit 50 in accordance with an input by a user or the like. Next, in step S103, the information acquisition unit 20 acquires information of the wireless tags 101, 102 and 103 and information of the sensors 201, 202 and 203 detected by the wireless tag reader 60. The information acquisition unit 20 then transmits the information to the manager determining unit 30 and the user determining unit 40.

(b) Next, in step S104, the manager determining unit 30 determines whether the article has been sold or purchased based upon the information acquired. Where the article has been sold or purchased, the process proceeds to step S107, and a new manager is determined and the manager of the article is changed. On the other hand, where the article has not been sold or purchased, the process proceeds to step S105, and it is determined whether the article has been abandoned. Where the article has been abandoned, the process proceeds to steps S107, where a new manager is determined and the manager of the article is changed. Meanwhile, where the article has not been abandoned, the process proceeds to step S106 and it is determined whether the article has been transferred. Where the article has been transferred (where the transfer mode has been received), a new manager is determined and the manager of the article is changed. Where the article has not been transferred, the process proceeds to step S108 without changing the manager.

(c) Next, a user change process is carried out. First of all, in step S108, the user determining unit 40 determines whether the foregoing condition for the user level 1 is satisfied based upon the information from the information acquisition unit 20. Where the condition for the user level 1 is not satisfied, the process proceeds to step S122 in FIG. 8. Where the condition for the user level 1 is satisfied, the process proceeds to step S109. In step S109, the user determining unit 40 determines whether the foregoing condition for the user level 2 is satisfied. Where the condition for the user level 2 is not satisfied, the user is set at the user level 1 in step S110 and the process proceeds to step S126 in FIG. 9. Meanwhile, where the condition for the user level 2 is satisfied, the process proceeds to step S111 in FIG. 7.

Figure 7:
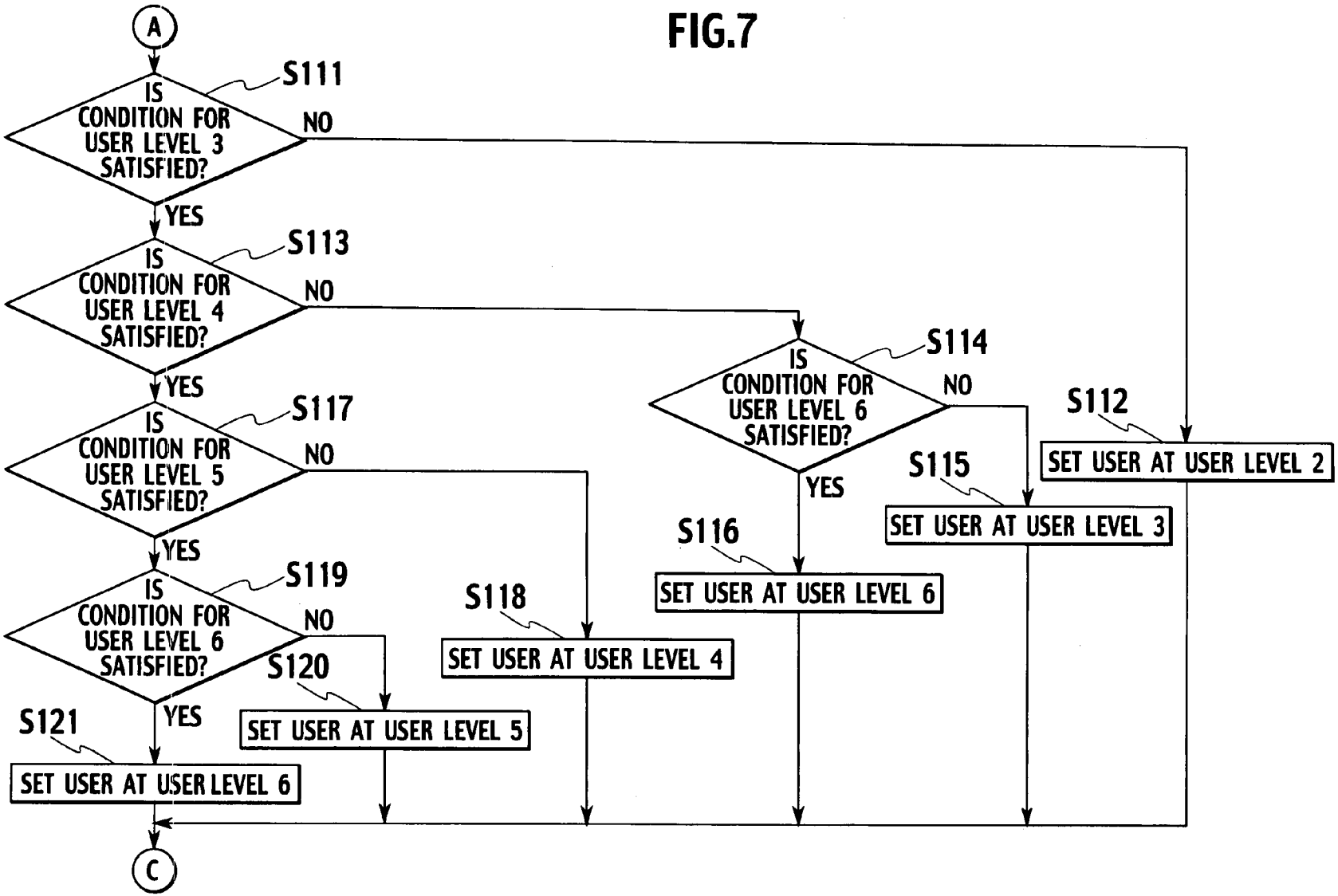
FIG. 7 is a flowchart (No. 2) showing the management method according to the embodiment.

(d) In step S111 in FIG. 7, the user determining unit 40 determines whether the foregoing condition for the user level 3 is satisfied. Where the condition for the user level 3 is not satisfied, the user is set at the user level 2 in step S112 and the process proceeds to step S126 in FIG. 9. Meanwhile, where the condition for the user level 3 is satisfied, the user determining unit 40 determines whether the aforementioned condition for the user level 4 is satisfied in step S113. Where the condition for the user level 4 is satisfied, the process proceeds to the step S117. Meanwhile, where the condition for the user level 4 is not satisfied, the user determining unit 40 determines whether the foregoing condition for the user level 6 is satisfied in step S114. Where the condition for the user level 6 is not satisfied, the user is set at the user level 3 in step S115 and the process proceeds to step S126 in FIG. 9. Where the condition for the user level 6 is satisfied, the user is set at the user level 6 in step S116 and the process proceeds to S126 in FIG. 9.

(e) Meanwhile, where the condition for the user level 4 is satisfied in step S113, the user determining unit 40 determines whether the foregoing condition for the user level 5 is satisfied in step S117. Where the condition for the user level 5 is not satisfied, the user is set at the user level 4 in step S118 and the process proceeds to step S126 in FIG. 9. Meanwhile, where the condition for the user level 5 is satisfied, the user determining unit 40 determines whether the condition for the user level 6 is satisfied in step S119. Where the condition for the user level 6 is not satisfied, the user is set at the user level 5 in step S120. Meanwhile, where the condition for the user level 6 is satisfied, the user is set at the user level 6 in step S121 and the process proceeds to step S126 in FIG. 9.

Figure 6:
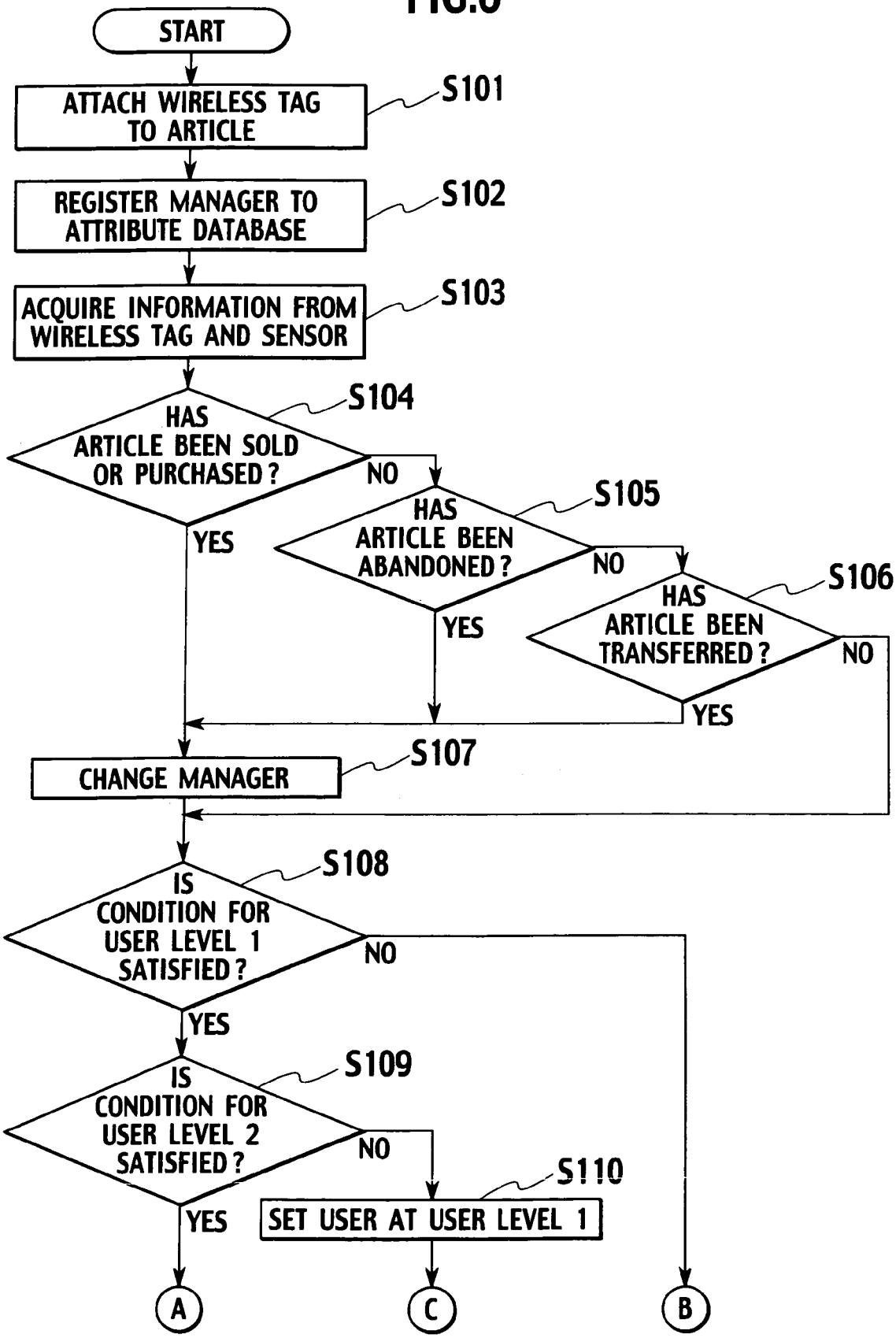
FIG. 6 is a flowchart (No. 1) showing a management method according to the embodiment.
Figure 8:
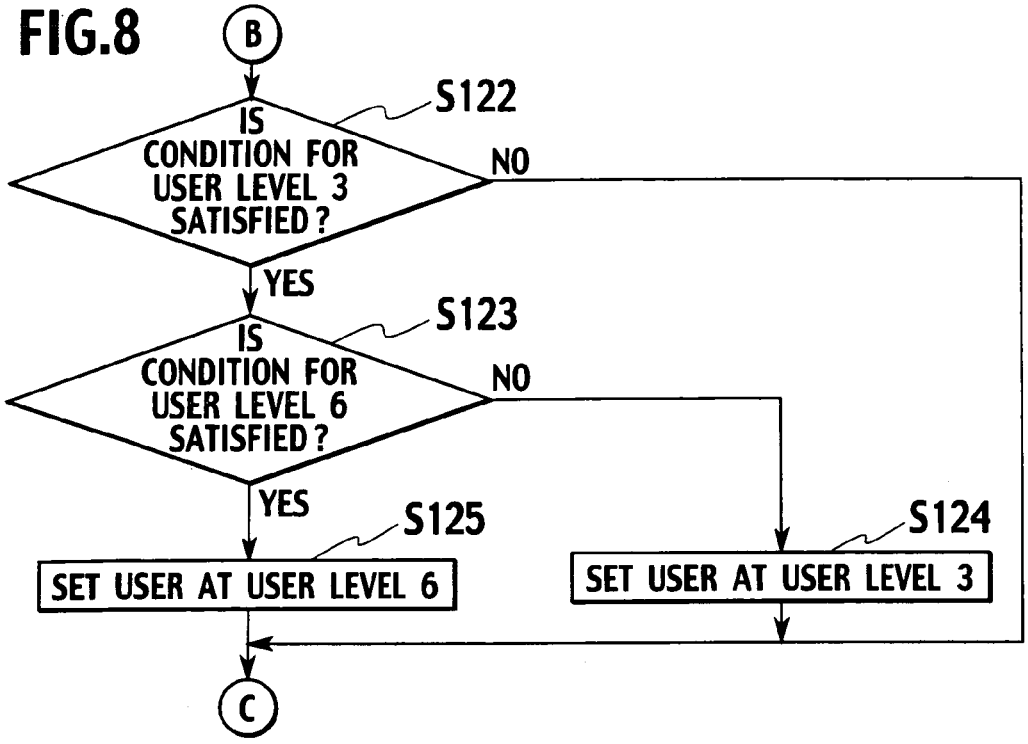
FIG. 8 is a flowchart (No. 3) showing the management method according to the embodiment.

(f) Meanwhile, where the condition for the user level 1 is not satisfied in step S108 in FIG. 6, the user determining unit 40 determines whether the foregoing condition for the user level 3 is satisfied in step S122 in FIG. 8. Where the condition for the user level 3 is not satisfied, the process proceeds to step S126 in FIG. 9. Meanwhile, where the condition for the user level 3 is satisfied, the user determining unit 40 determines whether the foregoing condition for the user level 6 is satisfied in step S123. Where the condition for the user level 6 is not satisfied, the user is set at the user level 3 in step S124. Meanwhile, where the condition for the user level 6 is satisfied, the user is set at the user level 6 in step S125 and the process proceeds to step S126 in FIG. 9.

Figure 9:
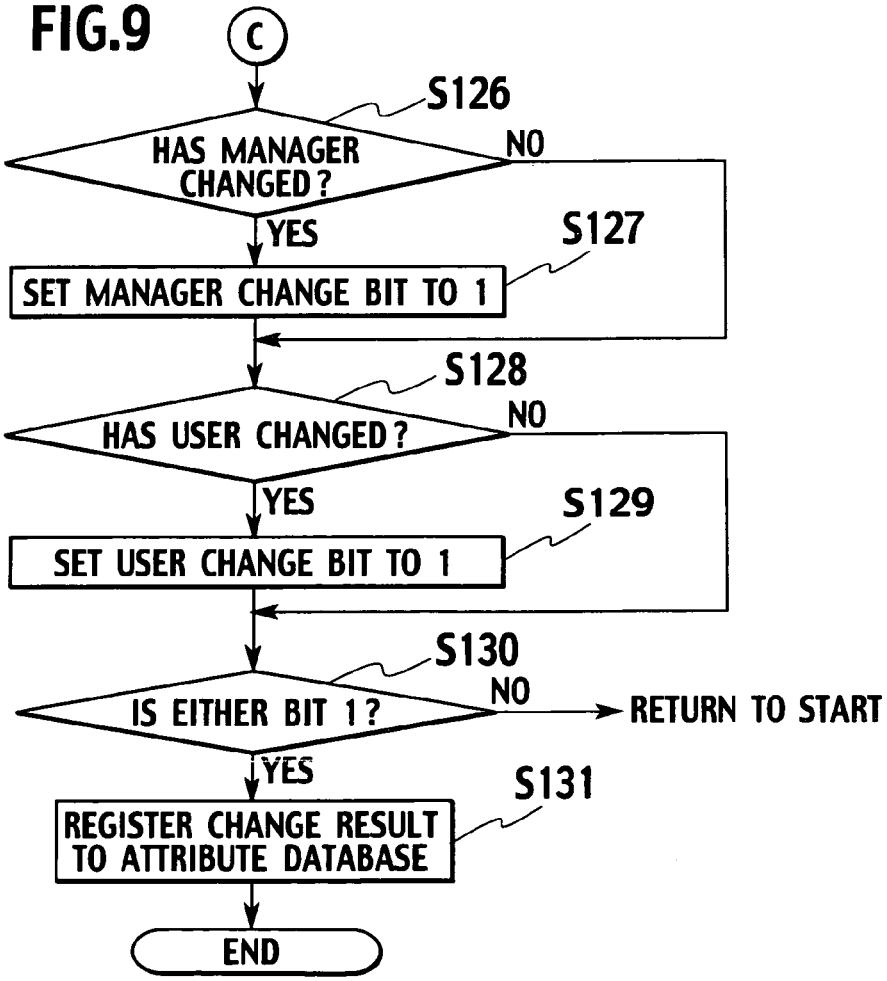
FIG. 9 is a flowchart (No. 4) showing the management method according to the embodiment.

(g) In step S126 in FIG. 9, the manager determining unit 30 determines whether the manager has been changed. Where the manager has not been changed, no further process is carried out. Where the manager has been changed, a manager change bit is set at 1 in step S127. Thereafter, in step S128, the user determining unit 40 refers to the item "user" in the attribute database and compares the user and the user level which have been set and the user and the user level in the attribute database to determine whether the user has been changed. Where the user has not been changed, no further process is carried out. Where the user has been changed, a user change bit is set at 1 in step S129. Thereafter, in step S130, it is determined whether either the manager change bit or the user change bit is 1. Where neither the manager change bit nor the user change bit is 1. the process returns to START. Where one of or both the manager change bit and the user change bit is 1. the result of the change is registered in the attribute database.

(Operations and Effects)

The management system and the management method according to this embodiment can set two attributes, manager and user, in a database as information of an owner of a wireless tagged article. Since information regarding plural kinds of owners can be held in the database, a status of an article can be grasped accurately. Moreover, by using this database, appropriate services can be provided in accordance with the status of the article.

For example, where a manager does not possess an article because, for example, the manager has lend the article to a user and if a user tries to abandon or resell the article, the manager is informed of the abandonment or the resale.

Moreover, where a predetermined wireless tag reader detects a wireless tag or a predetermined sensor detects a wireless tag, the management system and the management method according to this embodiment can determine a new manager based on the detection. Therefore, where an article has been purchased or abandoned, a new manager can be set.

Furthermore, the management system and the management method according to this embodiment can set user levels which represent degrees of relations between the users and articles, respectively, based upon detection by a predetermined tag reader or by a predetermined sensor, and hold the users and the user levels while associating them with each other. By holding the degrees of relations, a service corresponding to each degree of relation can be provided. For example, an advertisement about an article can be provided to a person who is proximate to the article or who seems interested in the article. Alternatively, where a user possesses an article owned by other person and the user has lost it, the person who has lost the article (the user) can be notified of the fact that the article has been lost.

(Other Embodiments)

The present invention has been described in accordance with the foregoing embodiment. However, it should not be understood that the descriptions and drawings included in this disclosure limit the present invention. It will be apparent to those skilled in the art that various alternative embodiments, other examples and operable technologies can be made from this disclosure.

For example, although it was described in the above embodiment that the registration unit 10 registers a manager when a wireless tag is attached to an article, a wireless tag to which a manager is registered in advance may be attached to the article. Alternatively, where a wireless tag is attached to an article, a wireless tag reader 60 or sensors 201, 202 and 203 may automatically transmit information to the management system 1 so that the management system 1 sets a manager.

Further, in FIG. 4, one manager and one user are associated with a wireless tag identifier, respectively. However, a plurality of managers and users may be associated with a wireless tag identifier. Needless to say, the plurality of users may be set at different user levels.

Moreover, the relations among the user levels 1 to 6 were described in FIG. 5. However, the relations among the user levels are not limited thereto, and the number of the user levels may be set arbitrarily.

Various modifications will become possible for those skilled in the art after receiving the teachings of the present disclosure without departing from the scope thereof.

What is claimed is:

1. A management system configured to manage an article to which a wireless tag is attached, comprising:

an attribute database configured to store an article identifier, manager information, and user information associated with each other;

a wireless tag reader configured to detect the article identifier and at least one of the manager information and the user information;

a sensor configured to detect status information indicating a status of the article;

a manager determining unit configured to determine a new manager based upon the attribute database, the status information, the article identifier detected by the wireless tag reader, and the manager information detected by the wireless tag reader; and a user determining unit configured to determine a new user based upon the attribute database, the article identifier detected by the wireless tag reader, and the user information detected by the wireless tag reader, wherein the article identifier identifies the article, the manager information identifies a manager to manage the article, the user information identifies a user related to the article, and at least one of the manager determining unit and the user determining unit update the attribute database based upon a result of determining the new manager or the new user.

2. The management system of claim 1, further comprising:

a condition table storing unit configured to store a condition table which associates a user level with a predetermined condition concerning the user level, wherein the user level indicates a degree of relation between the user and the article, the user determining unit determines the user level for the user based upon the condition table, the article identifier detected by the wireless tag reader, and the user information detected by the wireless tag reader, and the attribute database stores the user level, the article identifier, the manager information, and the user information associated with each other.

3. The management system of claim 1, wherein the status information includes at least one of information indicating whether the article has been purchased, abandoned, or transferred.

4. A method for managing an article to which a wireless tag is attached, comprising:

storing, at an attribute database, an article identifier, manager information, and user information associated with each other;

detecting, at a wireless tag reader, the article identifier, and at least one of the manager information and the user information;

detecting, at a sensor, status information indicating a status of the article;

determining, at a manager determining unit, a new manager based upon the attribute database, the status information, the article identifier detected by the wireless tag reader, and the manager information detected by the wireless tag reader;

determining, at a user determining unit, a new user based upon the attribute database, the article identifier detected by the wireless tag reader, and the user information detected by the wireless tag reader; and updating, at the manager determining unit or the user determining unit, the attribute database based upon a result of determining the new manager or the new user, wherein the article identifier identifies the article, the manager information identifies a manager to manage the article, and the user information identifies a user related to the article.

5. The management system of claim 4, further comprising:

storing, at a condition table storing unit, a condition table;

determining, at the user determining unit, a user level for the user based upon the condition table, the article identifier detected by the wireless tag reader, and the user information detected by the wireless tag reader; and storing, at the attribute database, the user level, the article identifier, the manager information, and the user information, wherein the user level indicates a degree of relation between the user and the article, and the condition table associates the user level with a predetermined condition concerning the user level.

6. The method for managing the article of claim 4, wherein the detecting the status information includes detecting at least one of information indicating whether the article has been purchased, abandoned, or transferred.

* * * * *